US005716913A

United States Patent [19]

Yamamoto et al.

[11] Patent Number: 5,716,913

[45] Date of Patent: Feb. 10, 1998

[54] METAL WORKING OIL COMPOSITION AND METHOD OF WORKING METAL

[75] Inventors: Yasuyoshi Yamamoto; Haruyo Inaba; Aritoshi Fukushima; Michiyoshi Sugioka, all of Tokyo, Japan

[73] Assignee: Asahi Denka Kogyo Kabushiki Kaisha, Tokyo, Japan

[21] Appl. No.: 732,466

[22] PCT Filed: Apr. 10, 1996

[86] PCT No.: PCT/JP96/00988

§ 371 Date: Nov. 5, 1996

§ 102(e) Date: Nov. 5, 1996

[87] PCT Pub. No.: WO96/33253

PCT Pub. Date: Oct. 24, 1996

[30] Foreign Application Priority Data

| | | | |
|---|---|---|---|
| Apr. 18, 1995 | [JP] | Japan | 7-092771 |
| Apr. 18, 1995 | [JP] | Japan | 7-092772 |
| Oct. 11, 1995 | [JP] | Japan | 7-263163 |

[51] Int. Cl.[6] ..... C10M 137/06; C10M 141/06

[52] U.S. Cl. ..... 508/365; 508/375; 72/42

[58] Field of Search ..... 508/364, 365, 508/375; 72/42

[56] References Cited

U.S. PATENT DOCUMENTS

| | | | |
|---|---|---|---|
| 4,539,125 | 9/1985 | Sato | 508/375 |
| 4,832,867 | 5/1989 | Seiki et al. | 508/364 |
| 4,840,740 | 6/1989 | Sato et al. | 508/364 |
| 4,846,983 | 7/1989 | Ward, Jr. | 508/364 |
| 5,356,547 | 10/1994 | Arai et al. | 508/364 |

FOREIGN PATENT DOCUMENTS

| | | |
|---|---|---|
| 51-40567 | 11/1976 | Japan . |
| 56-896 | 1/1981 | Japan . |
| 56-79193 | 6/1981 | Japan . |
| 59-108098 | 6/1984 | Japan . |
| 63-12920 | 3/1988 | Japan . |
| 5-62639 | 9/1993 | Japan . |

*Primary Examiner*—Jacqueline V. Howard
*Attorney, Agent, or Firm*—Young & Thompson

[57] ABSTRACT

A metal working oil composition, comprising, as a component (A), 25 wt. % or more of one or more zinc dithiophosphates represented by the following general formula (1):

(1)

wherein $R^1$ to $R^4$ represent a hydrocarbon group and, if necessary, as a component (B), 0.1 to 50 wt. % of a molybdenum compound.

22 Claims, 1 Drawing Sheet

METAL WORKING OIL COMPOSITION AND METHOD OF WORKING METAL

TECHNICAL FIELD

The present invention relates to a metal working oil composition, and more particularly to a metal working oil composition characterized by containing a zinc dithiophosphate in an amount more than conventional sensible amounts. The present invention also relates to a novel metal working oil composition wherein use is made of an organomolybdenum extreme-pressure agent instead of a chlorine extreme-pressure agent which has hitherto been used in metal working oil compositions. The present invention also relates to a novel metal working method characterized by using these metal working oil compositions.

BACKGROUND ART

Conventionally used lubricants employed in metal working, such as cutting, grinding, drawing, wire drawing, pressing, etc., are those which comprise a vegetable or animal oil or fat, a mineral oil, or a synthetic oil, or a mixture thereof, as a base oil, and an oily agent, an extreme-pressure agent, a rust preventive, an antioxidant, etc. added thereto. In recent years, metal working conditions, such as increases in size and precision of various working machines, an increase in hardness of metal materials, increases in speed and pressure involved in metal working conditions, and an increase in accuracy of the finished surfaces of metal products, have been made increasingly severe in keeping with the elevation of general technical levels, and the above lubricants have been required to have further higher extreme-pressure properties. To solve this problem, a chlorine extreme-pressure agent has hitherto been added.

However, chlorine extreme-pressure agents are apprehended about their toxicity, particularly their carcinogenicity. Thus, in view of the consideration for environment of late years, non-chlorine extreme-pressure agents have been increasingly considered preferable.

As additives alternative to chlorine extreme-pressure agents, there are zinc dithiophosphates (ZDTP). Examples of metal working oils containing ZDTP added thereto include a press working oil comprising a combination of a borate with ZDTP (see Japanese Patent Application Laid-Open No. 79193/1981), a water-based metal cutting oil comprising a combination of a polyoxyalkylamine with ZDTP (see Japanese Patent Application Laid-Open No. 108098/1984), and cutting oils containing ZDTP added thereto (see Japanese Patent Publication Nos. 12920/1988 and 40567/1986). The added amounts of ZDTP in these conventional ZDTP-containing metal working oils are at most about 20% based on the base oil.

On the other hand, cold forging as one of methods of plastically working metals is characterized in that worked products with a high strength, a high dimensional accuracy, a smooth surface and an approximately net shape can be mass-produced at a high rate. However, the cold forging is a metal working method which is carried out under very severe conditions and therefore various measures have been taken for the metal working oils and metal working techniques.

As a contrived example of its representative metal working technique, a phosphate coating treatment can be mentioned. The phosphate coating treatment is a technique on which the present progress of the cold forging is based. The phosphate coating treatment is a pretreatment wherein the surface of a metal to be processed is treated with a phosphate, such as zinc phosphate, to form a film of a metal phosphate on the metal surface.

However, the phosphate coating treatment is a pretreatment peculiar to cold forging and it has been said that in comparison with other metal working methods, the phosphate coating treatment is a drawback of cold forging in that the process becomes complicated. Accordingly, for the purpose of dispensing with the phosphate coating treatment, metal working oils have hitherto been developed. Metal working oils containing a zinc dithiophosphate (ZDTP) added thereto can be considered representatives thereof.

With respect particularly to oils for plastic working that utilizes plastic deformation of metals, probably because the demanded lubricity is exceptionally severe in comparison with cutting oils and the like, it has become apparent that conventionally suggested metal working oils to which ZDTP has been added are not satisfactory.

On the other hand, molybdenum oxysulfide dithiocarbamates (MoDTC) and molybdenum oxysulfide dithiophosphates (MoDTP) have hitherto been developed mainly as extreme-pressure additives in lubricating oils for internal combustion engines (see Japanese Patent Application Laid-Open No. 896/1981 and Japanese Patent Publication No. 62639/1993). Further, molybdenum amine compounds (MoAm) have also been developed as an extreme-pressure additive in lubricating oils for internal combustion engines (see Japanese Patent Publication No. 62639/1993). However, it has not been found to date that the excellent extreme-pressure additives, MoDTC, MoDTP, and MoAm, can positively be used particularly in plastic working oils.

Accordingly, an object of the present invention is to provide a metal working oil composition that exhibits very excellent performance particularly in plastic working and a metal working method wherein said composition is used.

DISCLOSURE OF THE INVENTION

Thus, the inventors of the present invention have earnestly promoted the development and have found that a metal working oil composition containing ZDTP added thereto in an amount largely exceeding conventional sensible amounts, and particularly a metal working oil composition obtained by adding a suitable amount of a specific molybdenum compound further to said composition can attain the above object.

The present invention has been made on the basis of the above finding and provides a metal working oil composition, comprising, as a component (A), 25 wt. % or more of one or more zinc dithiophosphates represented by the following general formula (1):

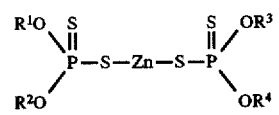

(1)

(wherein $R^1$ to $R^4$ represent a hydrocarbon group).

Further, the present invention provides a metal working oil composition, further comprising, as a component (B), 0.1 to 50 wt. % of one or more molybdenum compounds selected from the group consisting of molybdenum oxysulfide dithiocarbamates represented by the following general formula (2):

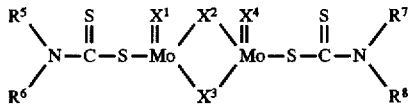

(2)

(wherein $R^5$ to $R^8$ represent a hydrocarbon group and $X^1$ to $X^4$ represent an oxygen atom or a sulfur atom), molybdenum oxysulfide dithiophosphates represented by the following general formula (3):

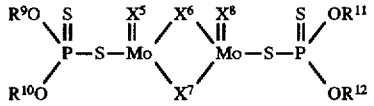

(3)

(wherein $R^9$ to $R^{12}$ represent a hydrocarbon group and $X^5$ to $X^8$ represent an oxygen atom or a sulfur atom), and molybdenum amine compounds obtained by reacting a hexavalent molybdenum compound with an amino compound represented by the following general formula (4):

$$R^{13}—NH—R^{14} \quad (4)$$

(wherein $R^{13}$ and $R^{14}$ represent a hydrogen atom or a hydrocarbon group, but they are not hydrogen atoms at the same time).

Further, the present invention provides a metal working method wherein use is made of these metal working oil compositions.

DETAILED DESCRIPTION OF THE INVENTION

Figure 1:
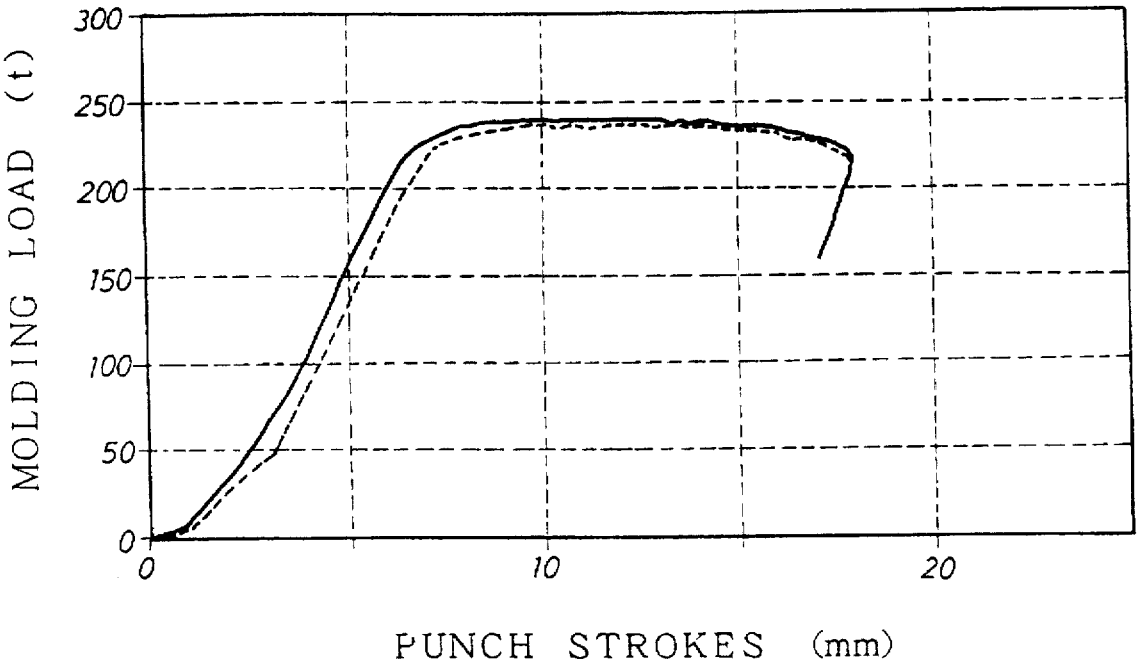
FIG. 1 is a graph showing the relationship between the punch strokes and the molding load in the backward extrusion processing test in Example 49.

The zinc dithiophosphates (ZDTP) as the component (A) of the present invention are compounds represented by the above general formula (1). In the above general formula (1), $R^1$ to $R^4$, which may be the same or different, represent a hydrocarbon group. The hydrocarbon group may be any of saturated, unsaturated, chain, cyclic, straight-chain, and branched-chain hydrocarbons and may be any of aliphatic, alicyclic, and aromatic hydrocarbons. For example, there can be mentioned an alkyl group, such as methyl, ethyl, propyl, isopropyl, butyl, isobutyl, tert-butyl, pentyl, isopentyl, neopentyl, tert-pentyl, hexyl, heptyl, octyl, 2-ethylhexyl, nonyl, decyl, undecyl, dodecyl, tridecyl, isotridecyl, myristyl, palmityl, and stearyl, an alkenyl group, such as propenyl, butenyl, isobutenyl, pentenyl, hexenyl, octenyl, 2-ethylhexenyl, and oleyl, a cycloalkyl group, such as cyclopentyl, cyclohexyl, cycloheptyl, methylcyclohexyl, and ethylcyclopentyl, an aryl group, such as phenyl, toluyl, xylyl, cumenyl, mesityl, styrenated phenyl, p-cumylphenyl, α-naphthyl, and β-naphthyl, an aralkyl group, such as benzyl and phenetyl, etc. Among them, an alkyl group having 8 to 20 carbon atoms, such as octyl, 2-ethylhexyl, nonyl, decyl, undecyl, dodecyl, tridecyl, isotridecyl, myristyl, palmityl, and stearyl, is preferable. Further, among these hydrocarbon groups, primary alkyl groups having 10 to 14 carbon atoms, that is, a decyl group an undecyl group, a dodecyl group, a tridecyl group, an isotridecyl group, and a myristyl group, are particularly preferable because they smell less, the decomposition temperature is high, and the lubricity is good.

ZDTP as the component (A) of the present invention may be ones produced by a usually industrially practiced production process and is, for example, produced by a method disclosed in Japanese Patent Publication No. 37251/1983.

The amount of ZDTP as the component (A) to be blended in the metal working oil composition of the present invention is an amount largely exceeding conventional sensible amounts and is specifically 25 to 100 wt. %, preferably 50 to 100 wt. %, and more preferably 70 to 100 wt. %, in the metal working oil composition. If the amount of ZDTP to be blended is below the above range, the difference in working properties from conventional metal working oils cannot noticeably be observed. The use thereof in the above range finds effects on working properties over those as expected in the case where the amount to be added is increased simply. Additionally stated, under not severe metal working conditions, it is used by diluting it with the base oil, but under particularly severe metal working conditions, only ZDTP as the component (A) can be used as an metal working oil composition.

Further, in the case where further severe metal working conditions are demanded, a molybdenum compound(s) may be added as the component (B).

Out of molybdenum oxysulfide dithiocarbamates (MoDTC) represented by the above general formula (2), molybdenum oxysufide dithiophosphates (MoDTP) represented by the above formula (3), and molybdenum amine compounds (MoAm) obtained by reacting a hexavalent molybdenum compound with an amino compound represented by the above general formula (4), one or two or more in combination may be used as the component (B) of the present invention.

In the above general formulas (2) to (4), $R^5$ to $R^{14}$, which may be the same or different are hydrocarbon groups and examples are an alkyl group, an alkenyl group, an aryl group, a cycloalkyl group, a cycloalkenyl group, etc.

Examples of the alkyl group include methyl, ethyl, propyl, isopropyl, butyl, isobutyl, tert-butyl, pentyl, isopentyl, neopentyl, tert-pentyl, hexyl, heptyl, octyl, 2-ethylhexyl, nonyl, decyl, undecyl, dodecyl, tridecyl, isotridecyl, myristyl, palmityl, stearyl, eicosyl, docosyl, tetracosyl, triacontyl, 2-octyldodecyl, 2-dodecylhexadecyl, 2-tetradecyloctadecyl, monomethyl-branched isostearyl, etc.

Examples of the alkenyl group include vinyl, allyl, propenyl, isopropenyl, butenyl, isobutenyl, pentenyl, isopentenyl, hexenyl, heptenyl, octenyl, nonenyl, decenyl, undecenyl, dodecenyl, teteradecenyl, oleyl, etc.

Examples of the aryl group include phenyl, toluyl, xylyl, cumenyl, mesityl, benzyl, phenetyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, styrenated phenyl, p-cumylphenyl, α-naphthyl, β-naphthyl, etc.

Examples of the cycloalkyl group and the cycloalkenyl group include cyclopentyl, cyclohexyl, cycloheptyl, methylcyclopentyl, methylcylohexyl, methylcylcoheptyl, cyclopentenyl, cyclohexenyl, cycloheptenyl, methylcylcopentenyl, methylcyclohexenyl, methylcycloheptenyl, etc.

In passing, one of $R^{13}$ and $R^{14}$ may be a hydrogen atom.

In order to obtain excellent lubricity and working properties, among these hydrocarbon groups, $R^5$ to $R^8$ in the above general formula (2) are preferably an alkyl group having 8 to 13 carbon atoms, $R^9$ to $R^{12}$ in the above general formula (3) are preferably an alkyl group having 6 to 13 carbon atoms, and $R^{13}$ and $R^{14}$ in the above general formula (4) are preferably an alkyl group having 6 to 18 carbon atoms.

Further, in the above general formulas (2) and (3), $X^1$ to $X^4$ and $X^5$ to $X^8$ each represent a sulfur atom or an oxygen atom and although all of $X^1$ to $X^4$ and $X^5$ to $X^8$ may be a sulfur atom or an oxygen atom, the ratio of the sulfur atom/oxygen atom in all X's is particularly preferably 1/3 to 3/1 in view of the lubricity and the corrosive properties.

The method of preparing the MoDTC that may be used in the present invention is preferably, for example, a method described in Japanese Patent Publication No. 12638/1981. Specifically, it can be obtained by reacting molybdenum trioxide or a molybdate with an alkali sulfide or an alkali hydrosulfide, then adding carbon disulfide and a secondary amine, and reacting them at a suitable temperature.

The method of preparing the MoDTP that may be used in the present invention is preferably, for example, methods described in Japanese Patent Application Laid-Open Nos. 87690/1986 and 106587/1986. Specifically, it can be obtained by reacting molybdenum trioxide or a molybdate with an alkali sulfide or an alkali hydrosulfide, then adding $P_2S_5$ and a secondary alcohol, and reacting them at a suitable temperature.

The MoAm that may be used in the present invention is a salt of molybdic acid ($H_2MoO_4$) with a primary or secondary amine and is preferably produced, for example, by a method described in Japanese Patent Application Laid-Open No. 285293/1986. Specifically, it can be obtained by reacting molybdenum trioxide or a molybdate with a primary or secondary amine at a temperature between room temperature and 100° C.

The amount of the molybdenum compounds as the component (B) that may be blended in the metal working oil composition of the present invention is 0.1 to 50 wt. %, preferably 0.1 to 20 wt. %, and more preferably 0.1 to 10 wt. %, in the metal working oil composition either in the case where one of the above compounds is used or in the case where two or more of the above compounds are used in combination. If the amount to be added exceeds the above range, the obtainable effect is not proportional to the added amount, making no sense technically.

In the metal working oil composition of the present invention, use can be made of a base oil as a component other than the above components (A) and (B). The base oil that can be used in the present invention may be a mineral oil, a synthetic oil, or oils and fats, or a mixture of these that can be used usually as a base oil for a metal working oil.

Herein the mineral oil refers to an oil separated, distilled, and purified from natural crude oil and examples thereof include paraffinic oils and naphthenic oils or oils obtained by hydrotreatment or solvent refining of these. These oils include mineral oils that are so-called spindle oil, machine oil, turbine oil, and cylinder oil.

On the other hand, the synthetic oil refers to a chemically synthesized lubricating oil and include poly-α-olefins, polyisobutylenes (polybutenes), diesters, polyol esters, phosphates, silicates, polyalkylene glycols, polyphenyl ethers, silicones, fluorinated compounds, alkylbenzenes, etc.

On the other hand, the oils and fats include beef tallow, lard, rapeseed oil, coconut oil, palm oil, rice bran oil, or soybean oil, hydrogenation products of these, or the like.

Among these various base oils, a mineral oil is preferred and in particular a paraffinic oil and a naphthenic oil are preferred.

By using, in place of chlorine extreme-pressure agents conventionally used as extreme-pressure agents for metal working oils, such as chlorinated paraffins, chlorinated fatty esters, and chlorinated oils and fats, the above ZDTP as the component (A) and the above molybdenum compound as the component (B), improvements in respect of influences on natural environment and hygiene as associated with chlorine are remarkable. Further, the above ZDTP as the component (A) and the above molybdenum compound as the component (B) are superior to chlorine extreme-pressure agents with respect to the extreme-pressure properties themselves.

Further, the metal working oil composition of the present invention can optionally contain various additives added thereto, such as a fatty acid, oils and fats, an antifoamer, an extreme-pressure agent, and a rust preventive. Among others, the addition of a sulfur extreme-pressure agent or a rust preventive is preferable to improve workabilities of metals.

Examples of the sulfur extreme-pressure agent include sulfurized oils, such as sulfurized olefins, sulfurized paraffins, and sulfurized lard, dialkylpolysulfides, dibenzyl sulfide, diphenyl disulfide, polyphenylene sulfides, alkyl mercaptans, alkylsulfonic acids, etc.

On the other hand, examples of the rust preventive include carboxylic acids, such as alkylsuccinic acids, naphthenic acid, abietic acid, linolic acid, linoleic acid, oleic acid, dimer acids, alkylphenoxyacetic acid, and xanthogenacetic acid, metal carboxylates, such as aluminum salt, zinc salt, magnesium salt, barium salt, and calcium salt of stearic acid, calcium allylstearate, zinc laurate, calcium salt and sodium salt of linoleic acid, lead soap of wool grease, magnesium palmitate, and lead salt, zinc salt, magnesium salt, and manganese salt of naphthenic acid, sulfonates, such as alkali metal sulfonates, alkali earth metal sulfonates, alkylnaphthalene sulfonates, petroleum sulfonates, amine sulfonates, and ammonium sulfonate, amines, such as rosin amines, stearylamine, palmitylamine, dicyclohexylamine, alkanolamines, and alkylimidazolines, polyoxyalkylene derivatives, such as sorbitan monooleate and sorbitan monooleate, and esters, such as pentaerythritol monooleate, erucic acid diesters, and palmitic acid triesters.

The sulfur extreme-pressure agent and/or rust preventive may suitably be used in such an amount that the effect of the present invention is not spoiled. It can be added in an amount of 0.01 to 60 wt. %, preferably 0.1 to 35 wt. %, and more preferably 1 to 20 wt. %, in the metal working oil composition. In addition, examples of extreme-pressure agents that may be added to the metal working oil composition of the present invention include borates, dithiocarbamates, acid phosphates, acid phosphites, dithiophosphates, alkyl phosphates, and aryl phosphates.

The metal working oil composition of the present invention has a viscosity of about 1 to 1,000 cSt, preferably 30 to 500 cSt, and more preferably 50 to 300 cSt, at 40° C. in the case where it is used as a plastic working oil while it has a viscosity of about 1 to 300 cSt, preferably 10 to 100 cSt, and more preferably 20 to 60 cSt, at 40° C. in the case where it is used as a cutting oil. If the viscosity is below the above range, the working properties are apt to become poor while if the viscosity is over the above range, the handling is apt to become difficult.

The use of the metal working oil composition of the present invention is not particularly restricted so long as it is used as a metal working oil, for example, for cutting and abrading. Preferably it is used for so-called plastic working.

Examples of the plastic working as called herein includes wire drawing, rolling, forging, press working, extrusion, bending, deep drawing, bulging, ironing, roll forming, shearing, rotational working, swaging, drawing, and pressure-applied working.

In cold forging among these, particularly, the metal working conditions are severe and usually a phosphate coating treatment comprising the following steps is indispensable. That is, for example, in steel working, the phosphate coating treatment comprises several steps including 1. washing the surface of the metal with an acid (an alkali), 2. washing with water, 3. treating with a phosphate, 4. washing with water and neutralizing, and 5. drying and thereafter applying a soap lubricant, such as sodium stearate, for working. On the other hand, in working a stainless steel containing chromium, nickel, etc., an oxalate coating treatment is carried out, in working a copper alloy, a copper oxide coating treatment or a cuprous oxide coating treatment is carried out, and in working an aluminum alloy, a zinc phosphate coating treatment or an aluminum silicofluoride coating treatment is carried out.

When the metal working oil composition of the present invention, i.e., the metal working oil composition containing 25 wt. % or more of ZDTP and, if required, a molybdenum compound is used, cold forging can be carried out under severe conditions without carrying out a conventionally required chemical conversion coating treatment. Specifically, it will suffice only to apply the metal working oil composition of the present invention onto the surface of the material to be worked before carrying out cold forging. Thus, by dispensing with a phosphate coating treatment, for example, the process can be shortened and simplified and the cost can be reduced.

The metal for which the metal working oil composition of the present invention is used is not particularly restricted and includes, for example, iron, aluminum, titanium, magnesium, copper, zinc, and manganese, their alloys (e.g., stainless steels and brass) or alloys thereof with silicon. When it is used particularly for iron, aluminum, and stainless steels, however, a favorable effect is exhibited.

EXAMPLES

Now, the present invention will be described more specifically with reference to Examples.

Examples 1 to 48 and Comparative Examples 1 to 10

Metal working oil compositions were prepared by formulating as shown in Tables 1 to 6 given below and with respect to the resulting metal working oil compositions, the maximum load, the abrasion mark diameter, the abrasion mark shape, the limiting drawing ratio (L.D.R.), and the working force were determined. The results are shown in Tables 1 to 6 below.

(Maximum Load)

The maximum load was measured by the method in accordance with ASTM D-2783-67T. That is, the test ball was set in position, the cup was filled with the test oil, and after a prescribed load was applied by the lever, the measurement was started. It was examined whether or not there was galling within a predetermined period (10 sec), and abrasion and friction were examined. Every time, the test ball and the test oil were replaced while changing the load. The conditions of the measurement were as follows:

Revolving speed of vertical shaft: 1,500 rpm

Friction velocity: 56 cm/sec

Test ball: ball bearing steel ball, ½", JIS B-1501-334

Loading method: lever type shock load, in the same direction for 10 sec

(Abrasion Mark Diameter and Abrasion Mark Shape)

The diameters of abrasion marks at three points were measured under a 10×100 microscope and the average value thereof was defined as the abrasion mark diameter. The shape of the abrasion mark caused under a load of 100 kg was also observed and was evaluated according to the following criteria:

◎: very excellent

○: good

Δ: poor

X: greatly deformed

(Drawability Test and Working Force Test)

To evaluate the performance as a plastic working oil, the SWIFT deep drawing test was performed. That is, using the designated tool (punch diameter: d=32 mm), the maximum plank diameter D that could be obtained by deep drawing was determined and the limiting drawing ratio (L.D.R) was calculated from the ratio of the maximum plank diameter D to the punch diameter.

L.D.R.=D/d

Parenthetically, the larger the value of the limiting drawing ratio is, the more excellent the lubricant is as a plastic working oil.

The test was carried out according to the following procedure:

First, SUS 304 material having a thickness of 1 mm was blanked with a crank press into pieces having a diameter of 70 mm and pieces having a diameter of 75 mm and then planks (test pieces) having diameters of 62 to 72 mm at 1-mm intervals were made therefrom by using a vertical lathe. Subsequently, the thus formed planks were degreased with benzine, the test oil was applied on the opposite surfaces and the die part and the deep drawing test was carried out using a drawability test machine manufactured by Roell & Korthaus KG under the following conditions:

Drawing die: inner diameter: 35 mm; shoulder radius: 6 mm; material: SKD 11

Punch: diameter: 32 mm; shoulder radius: 4.5 mm; material: SKD 11

Working speed: 1 mm/sec

Blank holder pressure: 500 kg

Further, when the blank having a diameter of 66 mm was subjected to the deep drawing test, the load at the working was measured as a working force. Incidentally, it can be said that the smaller the value of the working force is, the better the metal working oil composition is.

The components listed in Tables 1 to 6 are as follows:

Mineral oil: paraffin mineral oil refined by hydrogenation

ZDTP1: having n-dodecyl groups as $R^1$ to $R^4$ in the general formula (1)

ZDTP2: having isotridecyl groups as $R^1$ to $R^4$ in the general formula (1)

ZDTP3: having 2-ethylhexyl groups as $R^1$ to $R^4$ in the general formula (1)

ZDTP4: having stearyl groups as $R^1$ to $R^4$ in the general formula (1)

MoDTC1: having 2-ethylhexyl groups as $R^5$ to $R^8$ with sulfur atoms:oxygen atoms=2.2:1.8 for the composition of X's as a whole in the general formula (2)

MoDTC2: with 2-ethylhexyl groups:isotridecyl groups=1:1 for $R^5$ to $R^8$ and sulfur atoms:oxygen atoms=2.2:1.8 for the composition of X's as a whole in the general formula (2)

MoDTP1: having 2-ethylhexyl groups as with sulfur atoms:oxygen atoms=2.2:1.8 for the composition of X's as a whole in the general formula (3)

MoDTP2: having sec-hexyl groups as $R^9$ to $R^{12}$ with sulfur atoms:oxygen atoms=2.2:1.8 for the composition of X's as a whole in the general formula (3)

MoDTP3: having isotridecyl groups as with sulfur atoms:oxygen atoms=2.0:2.0 for the composition of X's as a whole in the general formula (3)

MoAm: a compound synthesized by the following process:

1 mol of molybdenum trioxide was dispersed in 540 ml of water under a stream of nitrogen and then 2 mol of ditridecylamine were added dropwise at 50 to 60° C. over 1 hour, followed by ripening at that temperature for 1 hour. Thereafter the aqueous layer was separated and removed. Thus a pale blue oil of an amine molybdate compound (MoAm) was synthesized. ($R^{13}$ and $R^{14}$=isotridecyl groups)

Sulfur extreme-pressure agent 1: sulfurized lard

Sulfur extreme-pressure agent 2: polyalkyl sulfide

Rust preventive 1: calcium sulfonate

Rust preventive 2: palmitylamine

Chlorine extreme-pressure agent: chlorinated paraffin

TABLE 1

(Unit of blended amount: wt %)

| Example | 1 | 2 | 3 | 4 | 5 | 6 | 7 | 8 | 9 | 10 |
|---|---|---|---|---|---|---|---|---|---|---|
| ZDTP1 | 30 | 50 | 60 | 70 | 40 | 40 | | | | 100 |
| ZDTP2 | | | | | | | 40 | 40 | 40 | |
| ZDTP3 | | | | | | | | | | |
| ZDTP4 | | | | | | | | | | |
| MoDTC1 | | | | | | | | | | |
| MoDTC2 | | | | | | | | | | |
| MoDTP1 | | | | | | | | | | |
| MoDTP2 | | | | | | | | | | |
| MoDTP3 | | | | | | | | | | |
| MoAm | | | | | | | | | | |
| Sulfur extreme-pressure agent 1 | | | | | 10 | | 10 | 10 | 10 | |
| Sulfur extreme-pressure agent 2 | | | | | | 10 | | | | |
| Rust preventive 1 | | | | | | | | | 3 | |
| Rust preventive 2 | | | | | | | | 3 | | |
| Chlorine extreme-pressure agent | | | | | | | | | | |
| Mineral oil | | | | | Balance | | | | | |
| Maximum load (Kg) | 158 | 224 | 251 | 282 | 251 | 224 | 224 | 251 | 251 | 355 |
| Abrasion mark diameter (mm) | 0.48 | 0.42 | 0.41 | 0.40 | 0.43 | 0.44 | 0.43 | 0.42 | 0.43 | 0.42 |
| Abrasion mark shape | ○ | ○ | ○ | ○ | ○ | ○ | ◎ | ◎ | ○ | ◎ |
| L. D. R. | 2.06 | 2.09 | 2.13 | 2.13 | 2.13 | 2.09 | 2.13 | 2.13 | 2.13 | 2.16 |
| Working force (Kg) | 6540 | 6400 | 6340 | 6300 | 6380 | 6420 | 6400 | 6420 | 6400 | 6280 |

TABLE 2

(Unit of blended amount: wt. %)

| Example | 11 | 12 | 13 | 14 | 15 | 16 | 17 | 18 | 19 | 20 |
|---|---|---|---|---|---|---|---|---|---|---|
| ZDTP1 | | | | | 20 | | 46 | 46 | 42 | 42 |
| ZDTP2 | | | | | | | | | | |
| ZDTP3 | 40 | 50 | | | 20 | 40 | | | | |
| ZDTP4 | | | 40 | 50 | | | | | | |
| MoDTC1 | | | | | | | | | | |
| MoDTC2 | | | | | | | | | | |
| MoDTP1 | | | | | | | 3 | | 11 | |
| MoDTP2 | | | | | | | | 3 | | 11 |
| MoDTP3 | | | | | | | | | | |
| MoAm | | | | | | | | | | |
| Sulfur extreme-pressure agent 1 | 10 | | 10 | | 10 | 10 | | | | |
| Sulfur extreme-pressure agent 2 | | | | | | | | | | |
| Rust preventive 1 | | | | | | 3 | | | | |
| Rust preventive 2 | | | | | | | | | | |
| Chlorine extreme-pressure agent | | | | | | | | | | |
| Mineral oil | | | | | Balance | | | | | |
| Maximum load (Kg) | 200 | 178 | 251 | 224 | 251 | 224 | 200 | 200 | 282 | 282 |
| Abrasion mark diameter (mm) | 0.43 | 0.42 | 0.42 | 0.41 | 0.43 | 0.43 | 0.44 | 0.44 | 0.43 | 0.44 |
| Abrasion mark shape | ○ | ○ | ○ | ○ | ○ | ○ | ○ | ○ | ◎ | ◎ |
| L. D. R. | 2.09 | 2.06 | 2.13 | 2.16 | 2.13 | 2.09 | 2.13 | 2.13 | 2.13 | 2.13 |
| Working force (Kg) | 6520 | 6560 | 6280 | 6300 | 6480 | 6500 | 6340 | 6340 | 6280 | 6300 |

TABLE 3

(Unit of blended amount: wt. %)

| Example | 21 | 22 | 23 | 24 | 25 | 26 | 27 | 28 | 29 | 30 |
|---|---|---|---|---|---|---|---|---|---|---|
| ZDTP1 | 42 | 42 | 40 | 40 | | 60 | 56 | 76 | 95 | |
| ZDTP2 | | | | | 60 | | | | | 56 |
| ZDTP3 | | | | | | | | | | |
| ZDTP4 | | | | | | | | | | |
| MoDTC1 | | | | | | | | | | |
| MoDTC2 | | | | | | | | | | |
| MoDTP1 | 2 | 2 | 3 | 3 | 1 | 1 | 20 | 2 | 5 | 15 |
| MoDTP2 | | | | | | | | | | |
| MoDTP3 | | | | | | | | | | |
| MoAm | | | | | | | | | | |
| Sulfur extreme-pressure agent 1 | 9 | | 9 | 9 | 8 | 8 | | | | 5 |
| Sulfur extreme-pressure agent 2 | | 9 | | | | | | | | |
| Rust preventive 1 | | | 3 | | 1 | 1 | | | | |
| Rust preventive 2 | | | | 3 | | | | | | |
| Chlorine extreme-pressure agent | | | | | | | | | | |
| Mineral oil | | | | | Balance | | | | | |
| Maximum load (Kg) | 282 | 251 | 316 | 282 | >447 | >447 | 398 | 398 | >447 | >447 |
| Abrasion mark diameter (mm) | 0.43 | 0.44 | 0.43 | 0.43 | 0.42 | 0.41 | 0.41 | 0.41 | 0.42 | 0.40 |
| Abrasion mark shape | ○ | ○ | ◎ | ◎ | ○ | ◎ | ◎ | ◎ | ◎ | ◎ |
| L. D. R. | 2.13 | 2.09 | 2.13 | 2.13 | 2.19 | 2.19 | 2.19 | 2.19 | 2.19 | 2.19 |
| Working force (Kg) | 6280 | 6360 | 6300 | 6280 | 6180 | 6180 | 6160 | 6160 | 6180 | 6160 |

TABLE 4

(Unit of blended amount: wt. %)

| Example | 31 | 32 | 33 | 34 | 35 | 36 | 37 | 38 | 39 | 40 |
|---|---|---|---|---|---|---|---|---|---|---|
| ZDTP1 | | 56 | 46 | 42 | 50 | 50 | 40 | 40 | 40 | 40 |
| ZDTP2 | 70 | | | | | | | | | |
| ZDTP3 | | | | | | | | | | |
| ZDTP4 | | | | | | | | | | |
| MoDTC1 | | | | | 3 | | 10 | | 2 | |
| MoDTC2 | | | | | | 3 | | | | |
| MoDTP1 | | | | | | | | | | |
| MoDTP2 | 2 | 20 | | | | | | | | |
| MoDTP3 | | | 3 | 11 | | | | | | |
| MoAm | | | | | | | | 10 | | 2 |
| Sulfur extreme-pressure agent 1 | 3 | | | | | | | | 10 | |
| Sulfur extreme-pressure agent 2 | | | | | | | | | | 10 |
| Rust preventive 1 | 3 | | | | | | | | | |
| Rust preventive 2 | | | | | | | | | | |
| Chlorine extreme-pressure agent | | | | | | | | | | |
| Mineral oil | | | | | Balance | | | | | |
| Maximum load (Kg) | >447 | >447 | 224 | 224 | 251 | 224 | 282 | 282 | 282 | 251 |
| Abrasion mark diameter (mm) | 0.40 | 0.40 | 0.43 | 0.43 | 0.44 | 0.44 | 0.44 | 0.43 | 0.43 | 0.43 |
| Abrasion mark shape | ◎ | ◎ | ○ | ◎ | ○ | ○ | ◎ | ◎ | ○ | ○ |
| L. D. R. | 2.19 | 2.19 | 2.13 | 2.13 | 2.09 | 2.09 | 2.09 | 2.09 | 2.13 | 2.09 |
| Working force (Kg) | 6160 | 6160 | 6360 | 6300 | 6480 | 6500 | 6480 | 6460 | 6420 | 6480 |

TABLE 5

(Unit of blended amount: wt. %)

| Example | 41 | 42 | 43 | 44 | 45 | 46 | 47 | 48 |
|---|---|---|---|---|---|---|---|---|
| ZDTP1 | 30 | 30 | | 60 | 55 | 75 | 90 | 95 |
| ZDTP2 | | | 60 | | | | | |
| ZDTP3 | | | | | | | | |
| ZDTP4 | | | | | | | | |
| MoDTC1 | 3 | 3 | 5 | 5 | 20 | 3 | | 5 |
| MoDTC2 | | | | | | | | |
| MoDTP1 | | | | | | | | |
| MoDTP2 | | | | | | | | |
| MoDTP3 | | | | | | | | |
| MoAm | | | | | | | 3 | |
| Sulfur extreme-pressure agent 1 | 10 | 10 | 10 | 10 | 5 | 5 | 5 | |
| Sulfur extreme-pressure agent 2 | | | | | | | | |

TABLE 5-continued (Unit of blended amount: wt. %)

| Example | 41 | 42 | 43 | 44 | 45 | 46 | 47 | 48 |
|---|---|---|---|---|---|---|---|---|
| Rust preventive 1 | 3 | | 1 | 1 | | | | |
| Rust preventive 2 | | | | | | | | |
| Chlorine extreme-pressure agent | | | | | | | | |
| Mineral oil | | | | Balance | | | | |
| Maximum load (Kg) | 224 | 178 | >447 | >447 | >447 | >447 | >447 | >447 |
| Abrasion mark diameter (mm) | 0.44 | 0.45 | 0.41 | 0.41 | 0.41 | 0.41 | 0.40 | 0.42 |
| Abrasion mark shape | ○ | ○ | ◎ | ◎ | ◎ | ◎ | ◎ | ◎ |
| L. D. R. | 2.09 | 2.09 | 2.16 | 2.16 | 2.19 | 2.19 | 2.19 | 2.19 |
| Working force (Kg) | 6580 | 6600 | 6340 | 6300 | 6280 | 6300 | 6200 | 6260 |

TABLE 6

(Unit of blended amount: wt %)

| Comparative Example | 1 | 2 | 3 | 4 | 5 | 6 | 7 | 8 | 9 | 10 |
|---|---|---|---|---|---|---|---|---|---|---|
| ZDTP1 | 10 | | | 5 | 5 | 8 | 10 | | | |
| ZDTP2 | | | | | | | | | | |
| ZDTP3 | | | | | | | | | | |
| ZDTP4 | | | | | | | | | | |
| MoDTC1 | | | | | | | 2 | 10 | 30 | |
| MoDTC2 | | | | | | | | | | |
| MoDTP1 | | | | | | 2 | | | | |
| MoDTP2 | | | | | | | | | | 30 |
| MoDTP3 | | | | | | | | | | |
| MoAm | | | | | | | | | | |
| Sulfur extreme-pressure agent 1 | | 30 | | 25 | | | | | | |
| Sulfur extreme-pressure agent 2 | | | | | | | | | | |
| Rust preventive 1 | | | | | | | | | | |
| Rust preventive 2 | | | | | | | | | | |
| Chlorine extreme-pressure agent | | | 30 | | 25 | | | | | |
| Mineral oil | | | | | Balance | | | | | |
| Maximum load (Kg) | 100 | 141 | 141 | 158 | 158 | 126 | 126 | 100 | 126 | 158 |
| Abrasion mark diameter (mm) | 0.55 | 0.66 | 0.59 | 0.52 | 0.55 | 0.50 | 0.50 | 0.53 | 0.76 | 0.50 |
| Abrasion mark shape | X | X | Δ | X | Δ | X | X | X | X | Δ |
| L. D. R. | 1.94 | 2.06 | 2.06 | 2.06 | 2.06 | 2.06 | 1.94 | 1.94 | 1.97 | 2.00 |
| Working force (Kg) | — | 6660 | 6680 | 6640 | 6660 | 6680 | — | — | — | 6600 |

*In Comparative Examples 1, 7, 8 and 9, the working force could not be measured.

Example 49 (Test of Metal Working Method)

Cold forging was carried out in the following manner:

The composition of Example 45 was used as a metal working oil. The metal working oil was applied onto a material (work) and the material was worked under the conditions given below. The same working was done for a material which had been subjected to a zinc phosphate coating treatment. The relationship between the punch strokes and the molding load obtained at that time is shown in FIG. 1.

Working method: backward extrusion (one mode of cold forging)

Material: SCM415.HRB 70 to 73; ø 39.7; height: 21.0

Punch diameter: ø 35 mm (titanium type special coating)

Die diameter: ø 40 mm

Press: Komatsu My Press LIC440-2 (manufactured by Komatsu Ltd.)

As is shown in FIG. 1, by the working with ø 35 and a depth (stroke) of 50 mm (1:1.4), the work on which the composition of Example 45 had been applied (shown in dotted line in FIG. 1) could be worked with a load lower than that for the material that had been subjected to the zinc phosphate coating treatment (shown in solid line in FIG. 1).

Then, a piece of chromium-molybdenum steel SCM415 and SCM420 (work) on which the composition of Example 45 had been applied was subjected to forward extrusion (one mode of cold forging) at a reduction of cross-sectional area of 73% to from a crankshaft. The molding load was reduced by 8% in comparison with the zinc phosphate coating treatment process.

Further, a piece of carbon steel S45C (work) on which the composition of Example 45 had been applied was subjected to composite working of forward extrusion and backward extrusion at a reduction of cross-sectional area of 60 to 65% to form a pinion shaft. The molding load was reduced by 5% in comparison with the zinc phosphate coating treatment process.

Industrial Applicability

The metal working oil composition of the present invention exhibits very excellent performance particularly in plastic working.

According to the method of the present invention for working a metal wherein use is made of the metal working oil composition of the present invention, smooth working can be attained even under working conditions more severe than conventional ones while dispensing with the complicated step of the phosphate coating treatment.

We claim:

1. A metal working oil composition, comprising, as a first component, 40 wt. % or more of one or more zinc dithiophosphates represented by the following general formula I:

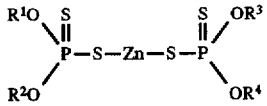

I wherein $R^1$ to $R^4$ represent a hydrocarbon group, in admixture with a base oil selected from the group consisting of mineral oil and synthetic oil.

2. The metal working oil composition as claimed in claim 1, further comprising, as a component (B), 0.1 to 50 wt. % of one or more molybdenum compounds selected from the group consisting of molybdenum oxysulfide dithiocarbamates represented by the following general formula II:

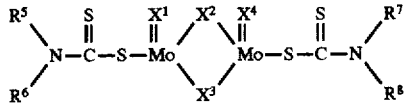

II wherein $R^5$ to $R^6$ represent a hydrocarbon group and $X^1$ to $X^4$ represent an oxygen atom or a sulfur atom, molybdenum oxysulfide dithiophosphates represented by the following general formula III:

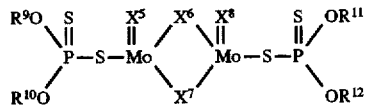

III wherein $R^9$ to $R^{12}$ represent a hydrocarbon group and $X^5$ to $X^8$ represent an oxygen atom or a sulfur atom, and molybdenum amine compounds obtained by reacting a hexavalent molybdenum compound with an amino compound represented by the following general formula IV:

$R^{13}$—NH—$R^{14}$ IV wherein $R^3$ and $R^{14}$ represent a hydrogen atom or a hydrocarbon group but they are not hydrogen atoms at the same time.

3. The metal working oil composition as claimed in claim 1, wherein no compound having a chlorine atom in the molecule is contained.

4. The metal working oil composition as claimed in claim 1, wherein $R^1$ to $R^4$ in the general formula (I), which may be the same or different, represent a primary alkyl group having 10 to 14 carbon atoms.

5. The metal working oil composition as claimed in claim 1, further comprising an extreme-pressure agent having a sulfur atom in the molecule and/or a rust preventive.

6. A plastic working oil composition, comprising the metal working oil composition as claimed in claim 1 as the main constitutional component.

7. The metal working oil composition as claimed in claim 2, wherein no compound having a chlorine atom in the molecule is contained.

8. The metal working oil composition as claimed in claim 2, wherein $R^1$ to $R^4$ in the general formula (I), which may be the same or different, represent a primary alkyl group having 10 to 14 carbon atoms.

9. The metal working oil composition as claimed in claim 2, further comprising an extreme-pressure agent having a sulfur atom in the molecule and/or a rust preventive.

10. A plastic working oil composition, comprising the metal working oil composition as claimed in claim 2 as the main constitutional component.

11. The metal working oil composition as claimed in claim 1, and having a viscosity of about 1 to 1,000 cSt at 40° C.

12. The metal working oil composition as claimed in claim 2, and having a viscosity of about 1 to 1,000 cSt at 40° C.

13. A method of working a metal which comprises applying onto the surface of the metal, a metal working oil composition comprising as a component 25% or more zinc dithiophosphates represented by the following general formula I:

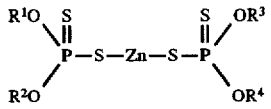

I wherein $R^1$ to $R^4$ represent a hydrocarbon group.

14. The method of working a metal according to claim 13, wherein the amount of the zinc dithiophosphates ranges from 50 to 100 wt. % in the metal working oil composition.

15. The method of working a metal according to claim 13, further comprising the step of cold forging the metal after application of the metal working oil composition.

16. The method of working a metal according to claim 13, wherein the metal working oil composition further comprises, as a second component, 0.1 to 50 wt. % of one of more molybdenum compounds selected from the group consisting of molybdenum oxysulfide dithiocarbamates represented by the following general formula II:

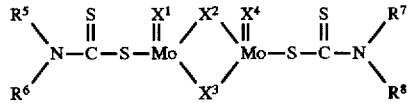

II wherein $R^5$ to $R^8$ represent a hydrocarbon group and $X^1$ to $X^4$ represent an oxygen atom or a sulfur atom, molybedum oxysulfide dithiophosphates represented by the following general formula III:

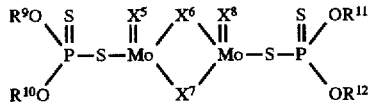

III $R^9$ to $R^{12}$ represent a hydrocarbon group and $X^5$ to $X^8$ represent an oxygen atom or a sulfur atom, and molybdenum amine compounds obtained by reacting a hexavalent molybdenum compound with an amino compound represented by the following general formula IV:

$R^{13}$—NH—$R^{14}$ IV wherein $R^{13}$ and $R^{14}$ represent a hydrogen atom or a hydrocarbon group but they are not hydrogen atoms at the same time.

17. The method of working a metal according to claim 14, wherein the metal working oil composition further comprises, as a second component, 0.1 to 50 wt. % of one of more molybdenum compounds selected from the group consisting of molybdenum oxysulfide dithiocarbamates represented by the following general formula II:

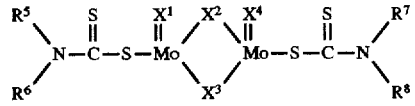

II wherein $R^5$ to $R^8$ represent a hydrocarbon group and $X^1$ to $X^4$ represent an oxygen atom or a sulfur atom, molybedum oxysulfide dithiophosphates represented by the following general formula III:

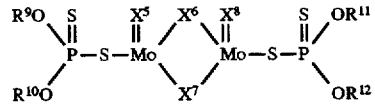

III $R^9$ to $R^{12}$ represent a hydrocarbon group and $X^5$ to $X^8$ represent an oxygen atom or a sulfur atom, and molybdenum amine compounds obtained by reacting a hexavalent molybdenum compound with an amino compound represented by the following general formula IV:

$R^{13}$—NH—$R^{14}$ IV wherein $R^{13}$ and $R^{14}$ represent a hydrogen atom or a hydrocarbon group but they are not hydrogen atoms at the same time.

18. The method of working a metal according to claim 15, wherein the metal working oil composition further comprises, as a second component, 0.1 to 50 wt. % of one of more molybdenum compounds selected from the group consisting of molybdenum oxysulfide dithiocarbamates represented by the following general formula II:

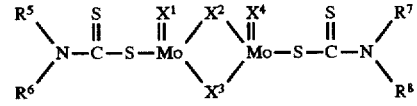

II wherein $R^5$ to $R^8$ represent a hydrocarbon group and $X^1$ to $X^4$ represent an oxygen atom or a sulfur atom, molybedum oxysulfide dithiophosphates represented by the following general formula III:

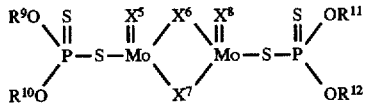

III $R^9$ to $R^{12}$ represent a hydrocarbon group and $X^5$ to $X^8$ represent an oxygen atom or a sulfur atom, and molybdenum amine compounds obtained by reacting a hexavalent molybdenum compound with an amino compound represented by the following general formula IV:

$$R^{13}—NH—R^{14} \qquad \text{IV}$$

wherein $R^{13}$ and $R^{14}$ represent a hydrogen atom or a hydrocarbon group but they are not hydrogen atoms at the same time.

19. A metal working oil composition, comprising, as an active component, 25 wt. % or more of one or more zinc dithiophosphates represented by the following general formula I:

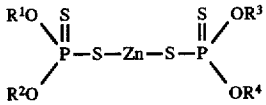

I wherein $R^1$ to $R^4$ represent a hydrocarbon group.

20. The metal working oil composition as claimed in claim 19, wherein the amount of the zinc dithiophosphates ranges from 50 to 100 wt. % in the metal working composition.

21. The metal working oil composition as claimed in claim 19, further comprising, as a component (B), 0.1 to 50 wt. % of one or more molybdenum compounds selected from group consisting of molybdenum oxysulfide dithiocarbamates represented by the following general formula II:

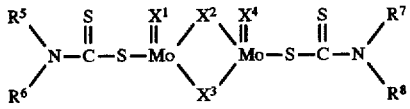

II wherein $R^5$ to $R^8$ represent a hydrocarbon group and $X^1$ to $X^4$ represent an oxygen atom or a sulfur atom, molybdenum oxysulfide dithiophosphates represented by the following general formula III:

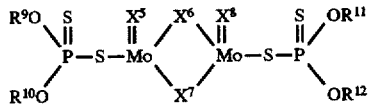

III wherein $R^9$ to $R^{12}$ represent a hydrocarbon group and $X^5$ to $X^8$ represent an oxygen atom or a sulfur atom, and molybdenum amine compounds obtained by reacting a hexavalent molybdenum compound with an amine compound represented by following general formula IV:

$$R^{13}—NH—R^{14} \qquad \text{IV}$$

wherein $R^{13}$ and $R^{14}$ represent a hydrogen atom or a hydrocarbon group but they are not hydrogen atoms at the same time.

22. The metal working oil composition as claimed in claim 21, wherein the amount of the zinc dithiophosphates ranges from 50 to 100 wt. % in the metal working composition.

* * * * *